US006240561B1

(12) United States Patent
Mc Ginnis

(10) Patent No.: US 6,240,561 B1
(45) Date of Patent: Jun. 5, 2001

(54) DISPOSABLE INFANT WEAR

(76) Inventor: Olivia E. Mc Ginnis, 420 Folsom Rd. Suite B, Roseville, CA (US) 95678

( * ) Notice: Subject to any disclaimer, the term of this patent is extended or adjusted under 35 U.S.C. 154(b) by 0 days.

(21) Appl. No.: 09/311,267

(22) Filed: May 14, 1999

Related U.S. Application Data

(60) Provisional application No. 60/085,738, filed on May 15, 1998.

(51) Int. Cl.[7] ..... A41B 13/06
(52) U.S. Cl. ..... 2/69.5
(58) Field of Search ..... 2/69, 69.5, 111, 2/123, 112, 75; 128/849, 855, 856

(56) References Cited

U.S. PATENT DOCUMENTS

| | | | | |
|---|---|---|---|---|
| 1,365,526 | * | 1/1921 | Milkes | 2/114 |
| 1,556,747 | * | 10/1925 | Bates, Jr. | 2/69 |
| 2,130,771 | * | 9/1938 | Mann | 2/114 |
| 2,234,546 | * | 3/1941 | Basch | 2/114 |
| 2,469,556 | * | 5/1949 | Jacobson | 2/83 |
| 2,521,609 | * | 9/1950 | Segerman | 2/114 |
| 2,578,323 | * | 12/1951 | Sillaway | 2/69.5 |
| 2,677,130 | * | 5/1954 | O'Hayer | 2/75 |
| 2,680,849 | * | 6/1954 | Munro | 2/69.5 |
| 2,702,385 | * | 2/1955 | Goldberg | 2/69.5 |
| 2,738,512 | * | 3/1956 | Winer | 2/80 |
| 3,555,567 | * | 1/1971 | Owen | 2/69.5 |
| 3,920,012 | * | 11/1975 | Patel | 128/134 |
| 3,965,487 | * | 6/1976 | Mazur | 2/69.5 |
| 4,745,636 | | 5/1988 | Lunt | 2/402 |
| 4,834,742 | | 5/1989 | Wilson et al. | 604/389 |
| 4,872,871 | | 10/1989 | Proxmire et al. | 604/394 |
| 4,931,115 | | 6/1990 | Pajunen | 156/73.1 |
| 5,023,952 | * | 6/1991 | Palmer | 2/69 |
| 5,129,406 | | 7/1992 | Magnusen et al. | 128/873 |
| 5,367,709 | * | 11/1994 | Teasley | 2/69 |
| 5,418,979 | * | 5/1995 | Senderowicz | 2/75 |
| 5,535,449 | * | 7/1996 | Dickey | 2/69 |
| 5,621,917 | | 4/1997 | Howsden | 2/111 |
| 5,680,653 | | 10/1997 | Mathis et al. | 2/123 |

* cited by examiner

*Primary Examiner*—John J. Calvert
*Assistant Examiner*—Alissa L. Hoey
(74) *Attorney, Agent, or Firm*—Robert Platt Bell

(57) ABSTRACT

Disposable infant wear garments that are made of soft pliable non-woven fabric in styles with hand and foot coverings, and the option of cutting these coverings off if they are not needed. Garments are designed with the body of each garment in one main piece for minimal seams. The garments have closures for adjustment for proper fit and added warmth. Each garment has openings for the infant's head, arms, and legs. There are openings for closures at the neck area for the purpose of putting the garment on the infant. The closures can then be fastened up to the neck for added warmth.

18 Claims, 22 Drawing Sheets

DISPOSABLE INFANT WEAR

CROSS-REFERENCE TO RELATED APPLICATIONS

The present application claims priority from Provisional U.S. patent application Ser. No. 60/085,738, filed May 15, 1998, and incorporated herein by reference.

FIELD OF THE INVENTION

This invention relates to disposable infant wear for newborn babies, and infants weighing up to 2 to 12 pounds. More specifically, this invention relates to infant wear made of a soft and pliable non-woven disposable fabric. The infant wear is intended to be used during the first weeks of life so that new parents can make better use their time and energy. Garments may be thrown away after each use in the same fashion as disposable diapers.

BACKGROUND OF THE INVENTION

Traditional infant clothing can become costly since newborn babies grow rapidly and garments are outgrown in only a couple of weeks. Clothing can be reused. However, stains from newborns are a common problem, resulting in garments which are unsightly.

Laundering traditional infant clothing may be costly and time consuming. Special soaps and fabric softeners must be used as well as extra rinse cycles to thoroughly clean infant clothing. Quite often, these products can irritate a baby's delicate skin. Disposable infant hospital gowns are a smaller version of adult type hospital gowns and are made with rough fabric with questionable means to secure them to infants. As such, they do not is allow for proper fit, any amount of extended use, protection, warmth or attractiveness. Hence, they are not serviceable for daily use.

A number of prior art references disclose disposable type garments. However, all have not been successfully adapted for use with infant wear, or have been applied only in specialized (e.g., neonatal) applications.

Howsden U.S. Pat. No. 5,621,917, issued Apr. 22, 1997, discloses an infant care garment. The garment is formed essentially as a sack with arm openings for the infant. Velcro® closures close the garment in the back, up the middle, and along he arms. The garment is designed particularly for neonatal intensive care use.

Schneider U.S. Pat. No. 5,611,095, issued Mar. 18, 1997, discloses a multi-function baby wrap. This reference is relevant to the extent that it appears to show a technique for making an infant garment from a single sheet with a minimum of labor. The wrap is designed to be used with a car seat or a baby stroller to warm the child. The wrap can be wrapped around the child without having to disturb or remove the child from a baby seat or stroller.

Mathis et al. U.S. Pat. No. 5,680,653, issued Oct. 28, 1997, discloses a surgical gown cuff and method of making the same. This reference is relevant to the extent that it teaches making disposable surgical gowns.

Magnusen et al. U.S. Pat. No. 5,129,406, issued Jul. 14, 1992, discloses an infant garment with crossed over arm position sleeves. This appears to be a straight jacket designed for infants (see FIGS. 1–5). The garment as disclosed is made of a soft polyester material and secured with Velcro®.

Pajunen U.S. Pat. No. 4,931,115, issued Jun. 5, 1990, discloses plastic clothing and a method of fabrication. The plastic clothing in Pajunen is made on a roll much like a roll of plastic film. Individual garments, gloves, and the like may be torn off at perforations. This reference is relevant to the extent that it shows the use of plastic welding techniques to form seams in clothing and also because the overall concept of disposable clothing.

SUMMARY OF THE INVENTION

Disposable infant wear will save time and money in shopping for newborn clothing that will be outgrown in a few short weeks. Disposable infant wear eliminates the need for laundry, thus there is no need to worry about special soaps, extra rinse cycles and extended laundry time. Disposable infant wear can be utilized to give infants attractive, comfortable, clean clothing at all times, in comparison to traditional clothing that requires laundering, and which stains easily due to the delicate stomachs of newborns.

Disposable infant wear is designed to be used for the first weeks after birth until newborns weigh about 2 to 12 pounds. The garments are available in three different sizes: One for premature infants weighing 2 to 4 pounds, one for infants weighing 5 to 7 pounds, and the third for infants weighing 7 to 12 pounds. The garments may be made of Dupont Sontara® non-woven polyester type fabric with various options for closures.

Each garment is designed to allow for natural unconfined movements of the infant. In manufacturing, the body of each garment is cut out in one piece, by any means such as die cutting, laser, or traditional scissors method. The preferred method is to use die cut templates since many garments can be cut at one time, thus more cost effective. Pieces are then folded for assembly to minimize seams. Most have only two (2) seams. Any joining method such as sonic welding, heat welding or sewn methods may seam the garments. However, the preferred method is sonic welding since it reduces the cost of manufacturing, eliminates burning or scorching, eliminates heat variation problems, hence no fumes for assemblies.

Garments are available with hand and foot coverings that protect the delicate skin of the infant from fingernail scratches and provide added warmth. However, the parent or care-giver can easily remove these coverings if they are not needed.

These products provide clean, attractive, warm, disposable infant wear at a time when new parents may be stressed, fatigued, not feeling well, or busy with other children and their demands. Such time constraints may leave them unprepared, unable or simply unwilling to routinely provide soft, warm, comfortable and clean apparel for the newborn when required.

The use of disposable garments save time, storage space, and the cost of purchasing permanent garments that infants otherwise rapidly outgrow. Also, disposable garments are easily stored flat.

Disposable garments are more sanitary than conventional clothing and are intended to be thrown away after soiling. This curtails unsanitary conditions and, therefore, bacterial growth and odor. The garments are designed with neck closures in the front or back. The preferred method is with the opening in the back to help eliminate the possibility of anything reaching the infant's mouth. These garments are soft, comfortable, and warm. They require no laundering, no folding, and they are disposable.

The garments appeal to the senses because they are attractive. Most parents will be proud to show off their infants in these unique garments which are warm, clean, and comfortable.

The garments are a great time saver for the parents or care-giver because the time that would be spent in purchasing, laundering, and folding conventional garments could be better spent on more worthwhile endeavors.

There are various versions of the disposable infant wear garments such as gowns, pants, pull over type shirts, open style shirts, one piece shirt/pants with short sleeves and legs, and one piece shirt/pants. They are available with long sleeves with hand coverings and foot coverings.

Although the focus is on disposable infant wear used in the first weeks of life in the home setting, the inventive matter would apply to any size of disposable garment with many variations made in this same manner. This include use in a hospital setting, use by older and larger children, adults, or seniors that may have physical limitations.

Disposable infant sheet made of the same non-woven polyester fabric with inserts saturated in mother's scent to comfort infant during sleep periods. This infant sheet can facilitate the infant/mother bonding process.

The mother would wear the inserts against her skin (inside of bra) for a period of time to pick up her scent. The insert would then be placed in the pocket of the sheet so that the infant can smell his/her mother and be comforted by her scent while sleeping.

BRIEF DESCRIPTION OF THE DRAWINGS

FIG. 4A-2 is a perspective view of the first disposable infant wear garment of FIG. 1A in a second step of dressing an infant.

FIG. 4A-3 is a perspective view of the first disposable infant wear garment of FIG. 1A in a third step of dressing an infant.

FIG. 4B-1 is a perspective view of the second disposable infant wear garment of FIG. 1B in a first step of dressing an infant.

FIG. 4B-2 is a perspective view of the second disposable infant wear garment of FIG. 1B in a second step of dressing on an infant.

FIG. 4B-3 is a perspective view of the second disposable infant wear garment of FIG. 1B as dressed on an infant, illustrating the fastening technique.

FIG. 4C-1 is a front view of the third disposable infant wear garment of FIG. 1C, as assembled.

FIG. 4C-2 is a perspective view of the third disposable infant wear garment of FIG. 1C in a first step of dressing an infant.

FIG. 4C-3 is a perspective view of the third disposable infant wear garment of FIG. 1C in a second step of dressing an infant.

FIG. 4C-4 is a perspective view of the third disposable infant wear garment of FIG. 1C in a third step of dressing an infant.

DETAILED DESCRIPTION OF THE INVENTION

Figure 1A:
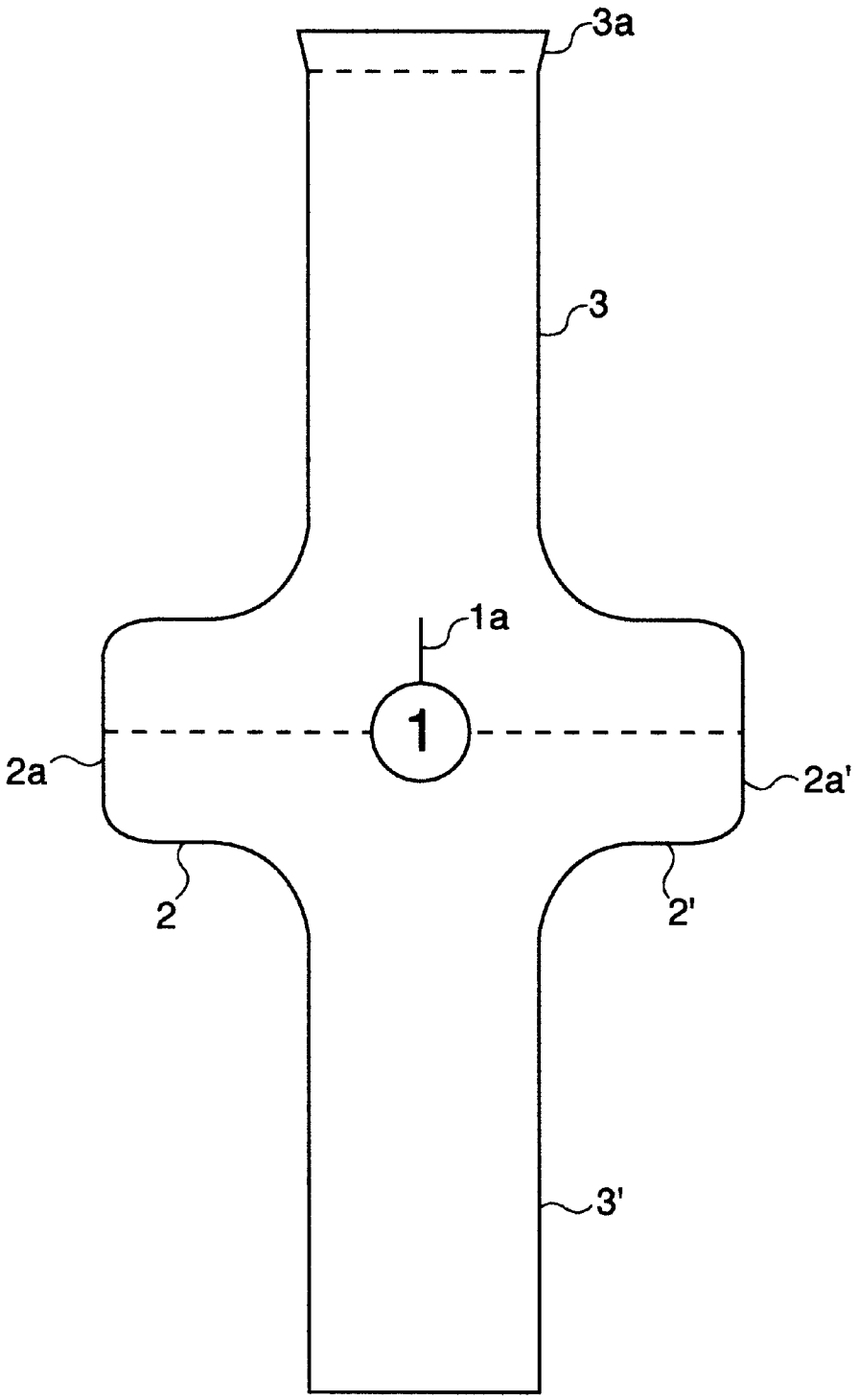
FIG. 1A is a top view of a pattern cut-out of a first disposable infant wear garment of the present invention.

In the following detailed description of the invention, like reference numerals have been used to describe like (or analogous elements among the various embodiments.

A first embodiment of the present invention is described in connection with FIGS. 1A, 2A, 3, 4A-1, 4A-2, and 4A-3.

FIG. 1A is a top view of a pattern cut-out of a first disposable infant wear garment of the present invention. The garment of FIG. 1A is a disposable infant gown cut in one piece with a neck opening 1, and two sleeves 2 and 2' with hand covering 2*a* centrally located with the body of the garment front 3 and back 3' extending in opposite directions. The front body of the garment extends 4 inches further to form a foldable flap 3*a*. This foldable flap operates in a similar manner to flaps used in Glad® sandwich bags. A portion of the bottom of the gown may be turned inside out to form a closure without the need for a closure mechanism such as hook and loop fastener (although one may be provided as an alternative embodiment). There is a 2" slit at the back of the neck 1*a*.

Figure 2A:
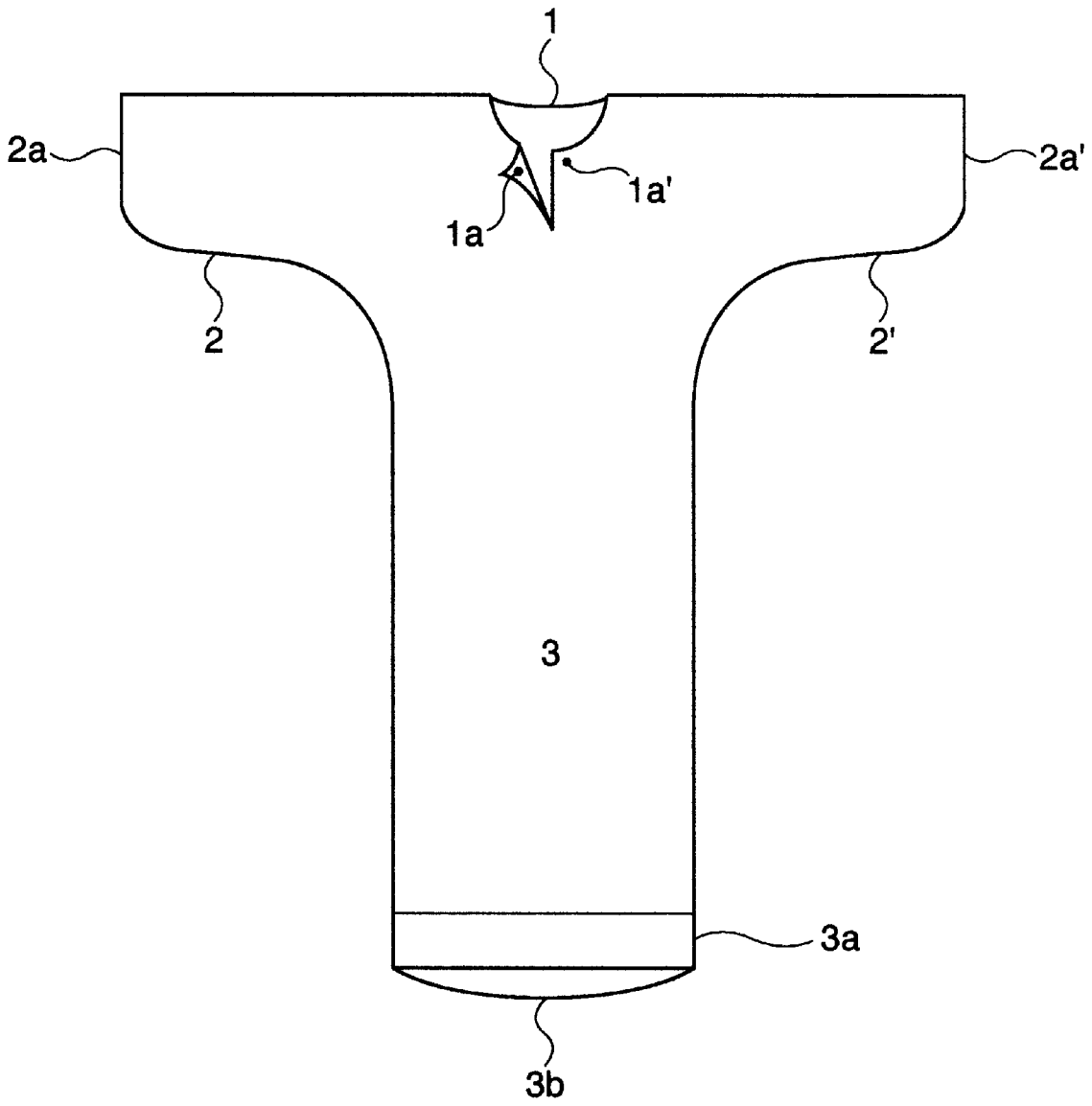
FIG. 2A is a front view of the first disposable infant wear garment of FIG. 1A in assembled form.

FIG. 2A is a front view of the first disposable infant wear garment of FIG. 1A in assembled form. In FIG. 2A, fabric cut from the pattern of FIG. 1A may be folded over the dotted line as indicated in FIG. 1A and joined along the edges to form an infant garment. As previously noted, the side edges of the garment may be joined by sewing (e.g., serging or the like) or by heat or sonic welding, adhesives, or the like. In the preferred embodiment, garment 3 may be fabricated from Dupont® Sontara® spunlaced polyester or polyester blended fabric. The *Dupont® Nonwovens Sontara® Technologies Spunlaced Fabrics Material Safety Data Sheet*, incorporated herein by reference, further describes properties of the material and bonding techniques commonly used. Any of such bonding techniques may be used within the spirit and scope of the present invention. Similarly, other types of non-wovens spun fabrics may be used within the spirit and scope of the present invention.

Once the garment is assembled, a neck opening 1 is formed, along with two sleeves 2 and 2' with hand coverings 2*a* and 2*a*'. The body of garment 3 may extend down with a folded flap 3*a* which may be folded over back 3*b* to cover up the infant's feet. Hook and loop (e.g., Velcro™ brand hook-and-loop fasteners), or desired closure system components, may be attached at each side of slit at neck opening 1*a* and 1*a*'. Other types of fasteners may be used within the spirit and scope of the present invention. For example, adhesive strips with peel-off backings (similar to that used in packaging technologies and disposable diapers) may be used to further reduce costs. Since the garment may be used only once, such an adhesive strip may be practicable. Moreover, the use of such adhesives may force the user to discard the garment after one use, preventing unsanitary re-use of the garment. Reclosable adhesives or fasteners may allow the garment to be reused a limited number of times.

Note also that the use of folding reduces the number of seams required, and thus reduces overall cost of the garment, allowing disposable use.

Figure 3:
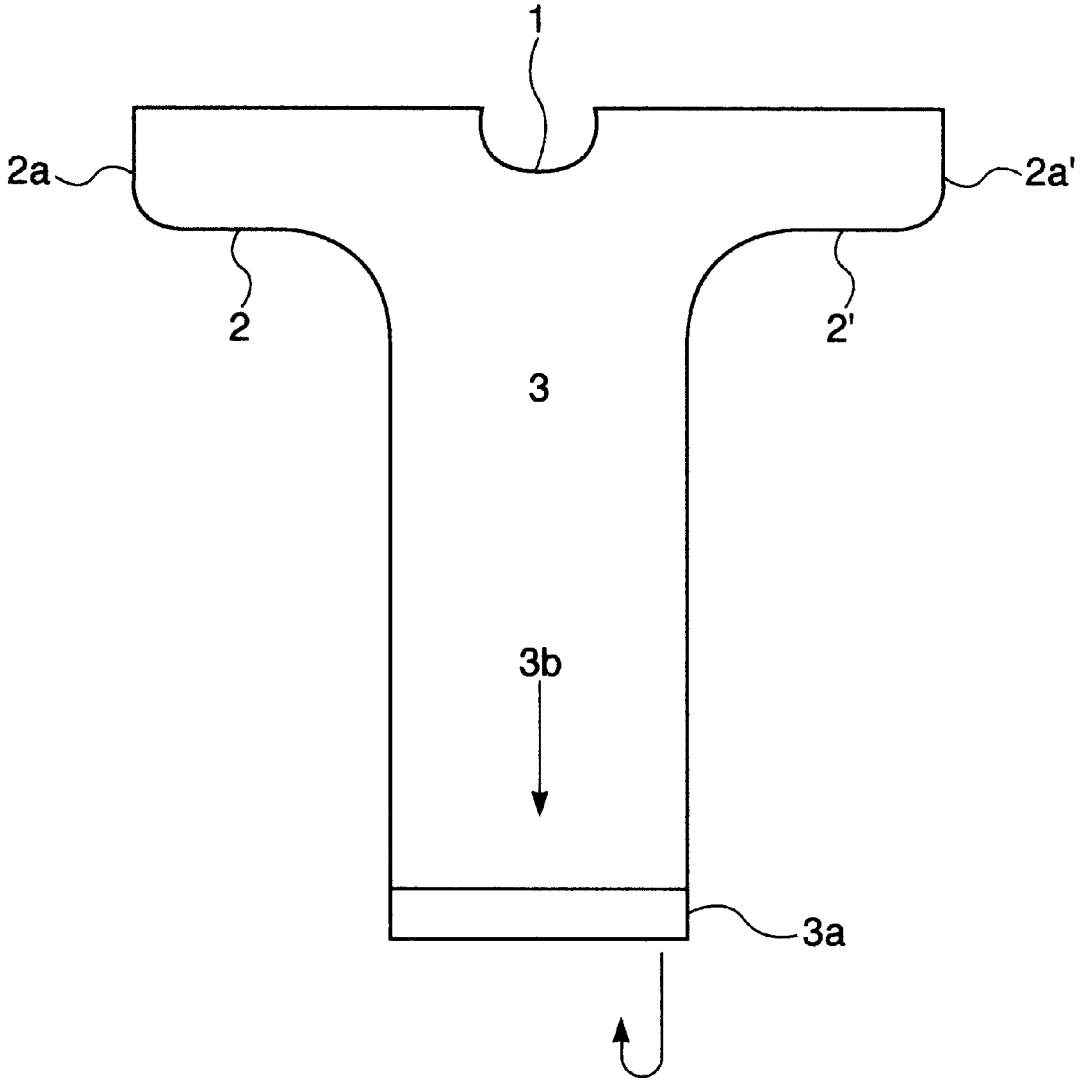
FIG. 3 is a back view of the first disposable infant wear garment of FIG. 1A in assembled form.

FIG. 3 is a back view of the first disposable infant wear garment of FIG. 1A in assembled form. FIG. 3 further illustrates neck opening 1, two sleeves 2 and 2' with hand covering 2*a* and 2*a*'. The body of the garment 3 extends down from there with folded flap 3*a* over back 3*b*. Note that flap 3*a* may be left unfolded if foot covering is not desired. Note also that hand coverings 2*a* and 2*a*' may be heat sealed, sewn, or glued along with the rest of the side seams of the garment to form closed hand coverings, to protect an infant and prevent heat loss. As will be discussed below, these hand coverings may be optionally cut off, allowing the garment to function as a more traditional sleeved infant garment with hand openings.

Figures 1, 4A:
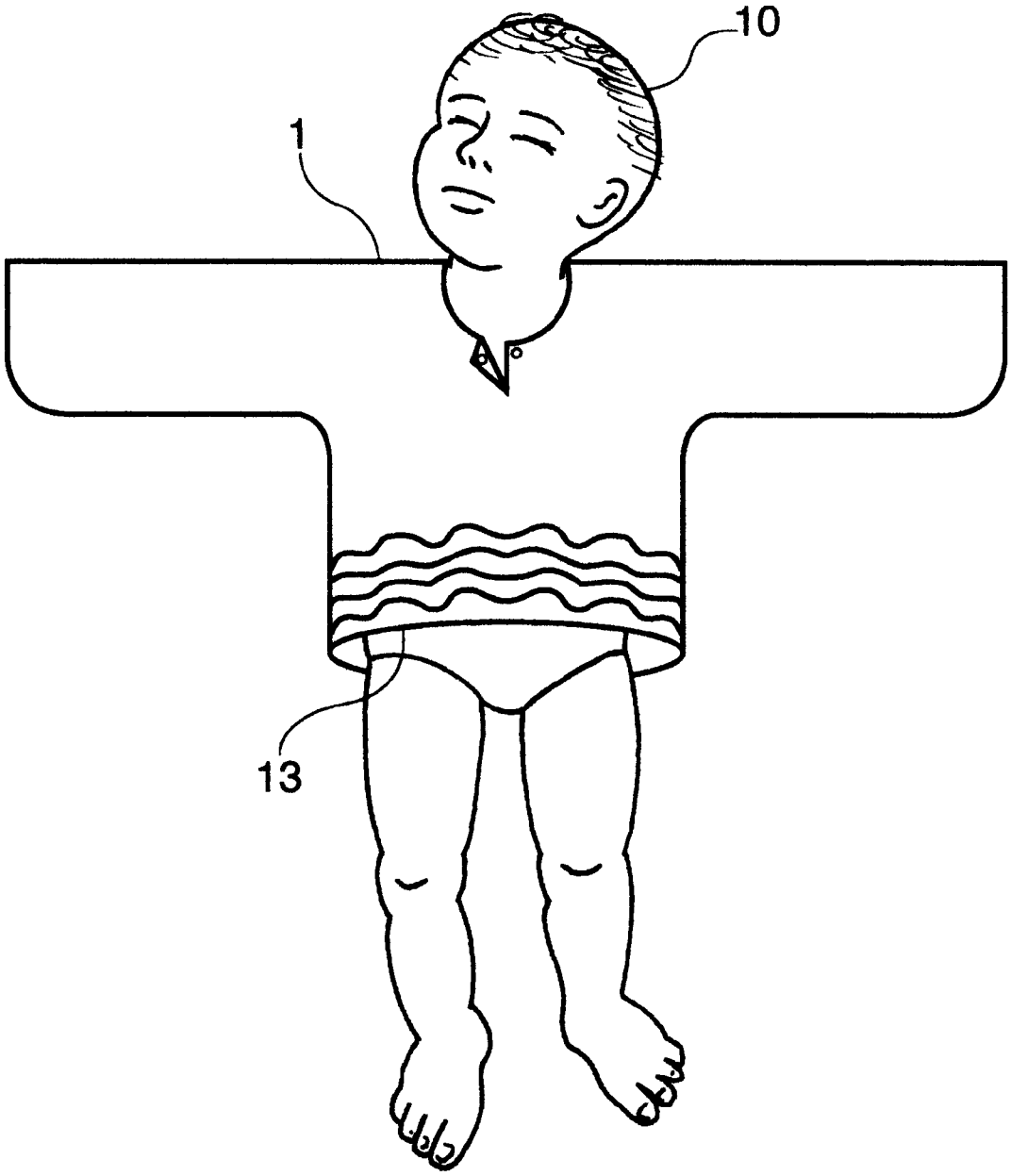
FIG. 4A-1 is a perspective view of the first disposable infant wear garment of FIG. 1A in a first step of dressing an infant.

FIG. 4A-1 is a perspective view of the first disposable infant wear garment of FIG. 1A in a first step of dressing an infant. In FIG. 4A-1, bottom opening 13 is opened to place the garment over the head of infant 10 and pulled down until the head of infant 10 is put through neck opening 1.

Figures 2, 4A:
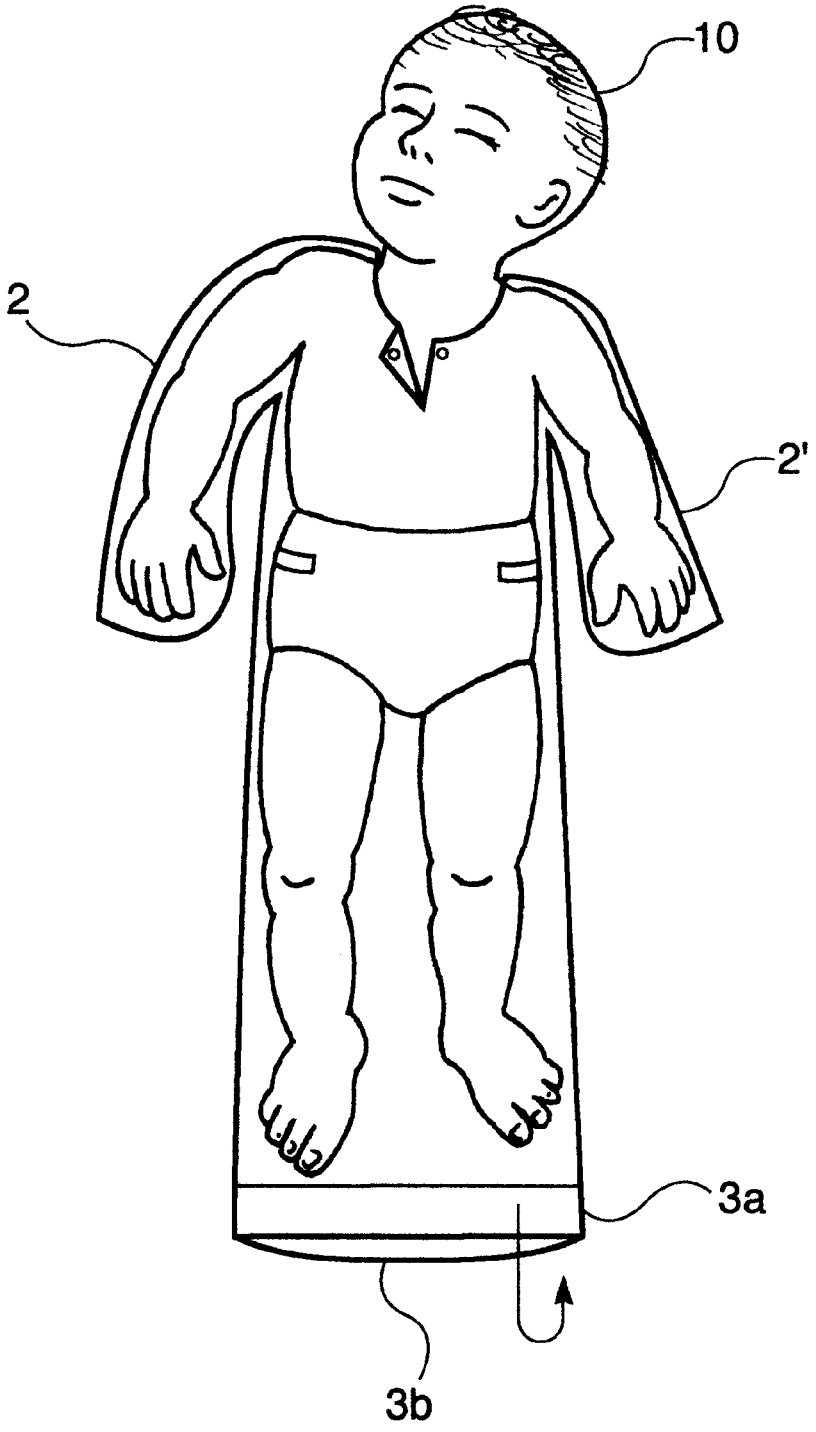
Figures 3, 4A:
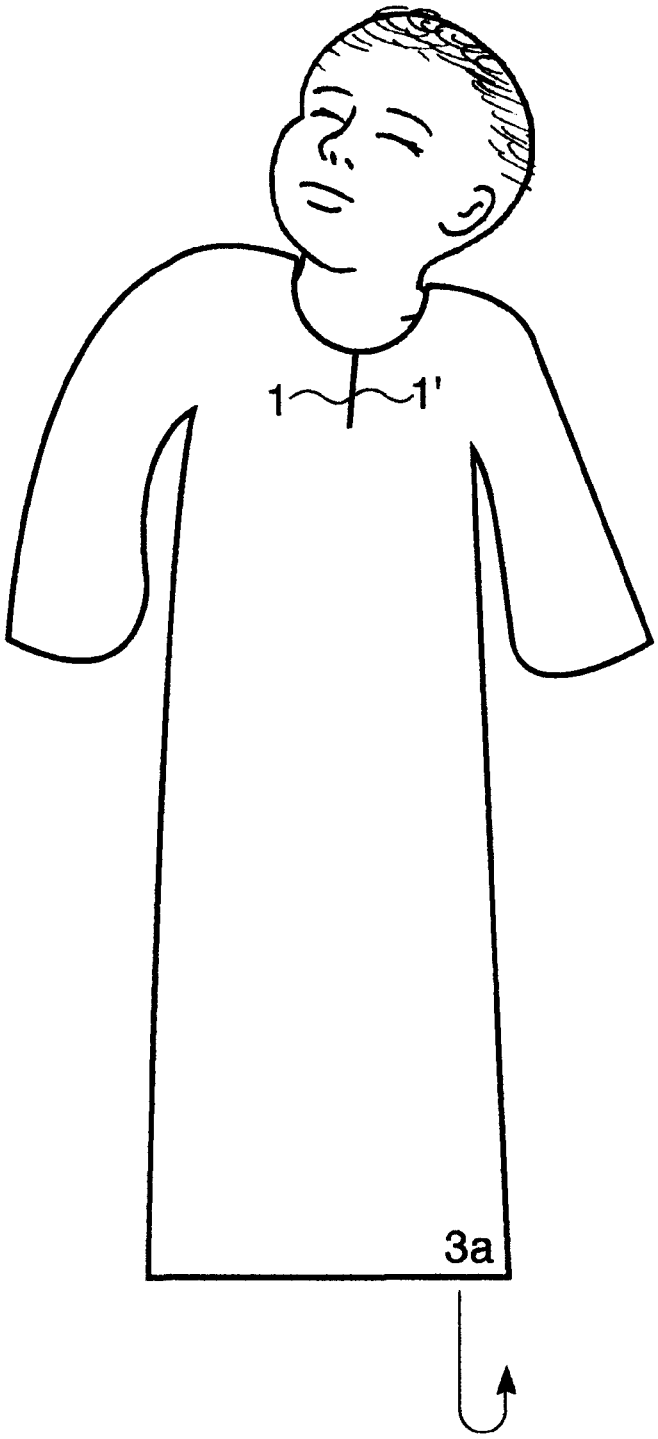

FIG. 4A-2 is a perspective view of the first disposable infant wear garment of FIG. 1A in a second step of dressing an infant. In FIG. 4A-2, arms of infant 10 may be inserted into respective sleeves 2 and 2'. The bottom edge of the body of the garment is then pulled down over the body of infant 10 and down beyond the feet of infant 10.

FIG. 4A-3 is a perspective view of the first disposable infant wear garment of FIG. 1A in a third step of dressing an infant. In FIG. 4A-3, the left facing side of the neck opening 1 with closure is closed over the right side of neck opening 1' with a closure system (e.g., hook and loop fastener, plastic snap, adhesive dot, or the like). The bottom edge 3*a* is folded over the back bottom of gown 3*b* to cover the feet if desired. As illustrated in FIG. 4A-3, the garment covers the infant to prevent heat loss, while keeping the infant's head and breathing passages clear.

A second embodiment of the present invention is described in connection with FIGS. 1B, 2B, 4B-1, 4B-2, and 4B-3.

Figure 1B:
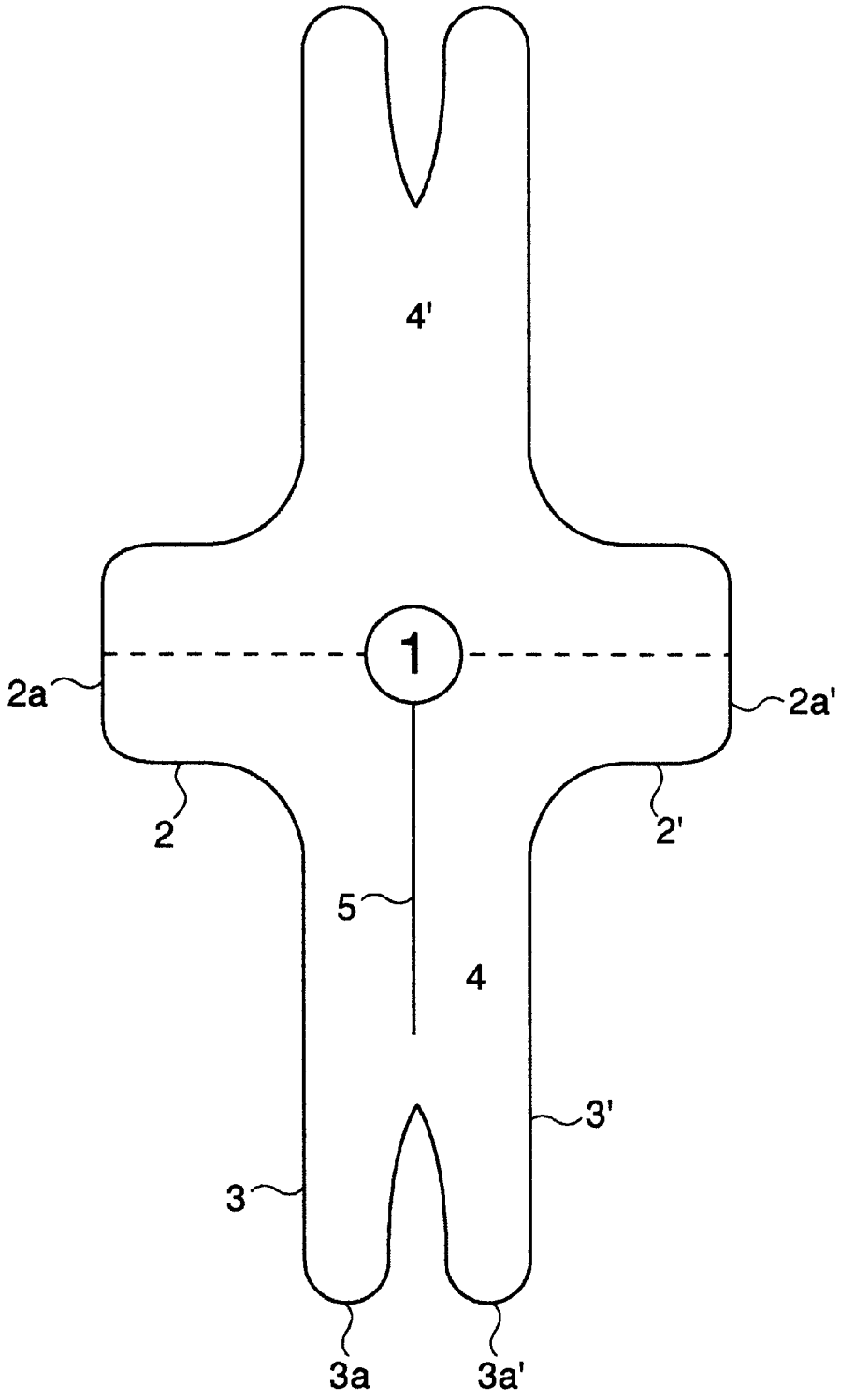
FIG. 1B is a top view of a pattern cut-out of a second disposable infant wear garment of the present invention.

FIG. 1B is a top view of a pattern cut-out of a second disposable infant wear garment of the present invention. The garment of FIG. 1B is a disposable one piece infant garment cut in one piece with a neck opening 1, and two sleeves 2 and 2' with hand coverings 2*a* and 2*a*'and two legs 3 and 3' with foot coverings 3*a* and 3*a*' centrally located with the body of the garment front 4 and back 4' extending in opposite directions. There is an opening 5 down the back center of the garment. Opening 5 may also be used as a front opening is desired.

Figure 2B:
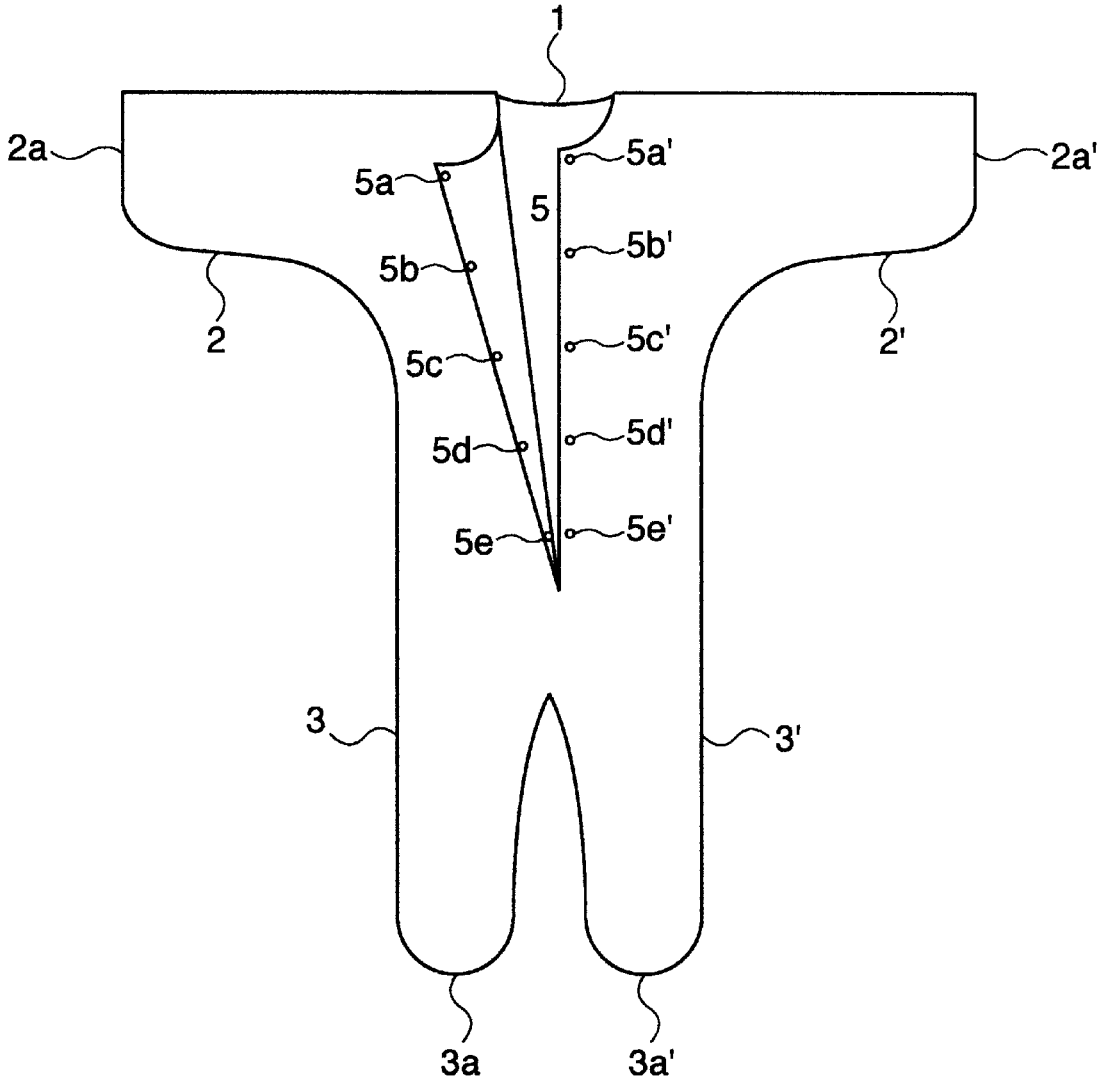
FIG. 2B is a front view of the second disposable infant wear garment of FIG. 1B in assembled form.

FIG. 2B is a front view of the second disposable infant wear garment of FIG. 1B in assembled form. In FIG. 2B, the pattern of FIG. 1B has been folded over where indicated by the dotted line in FIG. 1B and the edges joined. The resultant garment forms a neck opening 1, two sleeves 2 and 2' with hand coverings 2*a* and 2*a*' and legs 3 and 3' with foot coverings 3*a* and 3*a*'.

Hook and loop or desired closure system components 5*a*, 5*a*', 5*b*, 5*b*', 5*c*, 5*c*' 5*d*, 5*d*', 5*e*, and 5*e*' may attached at equal intervals down the center to form a closure. Note that the number of closure components may be varied or in the alternative, a single closure component (e.g., hook-and-loop fastener strip or adhesive strip) may be provided.

Figures 1, 4B:
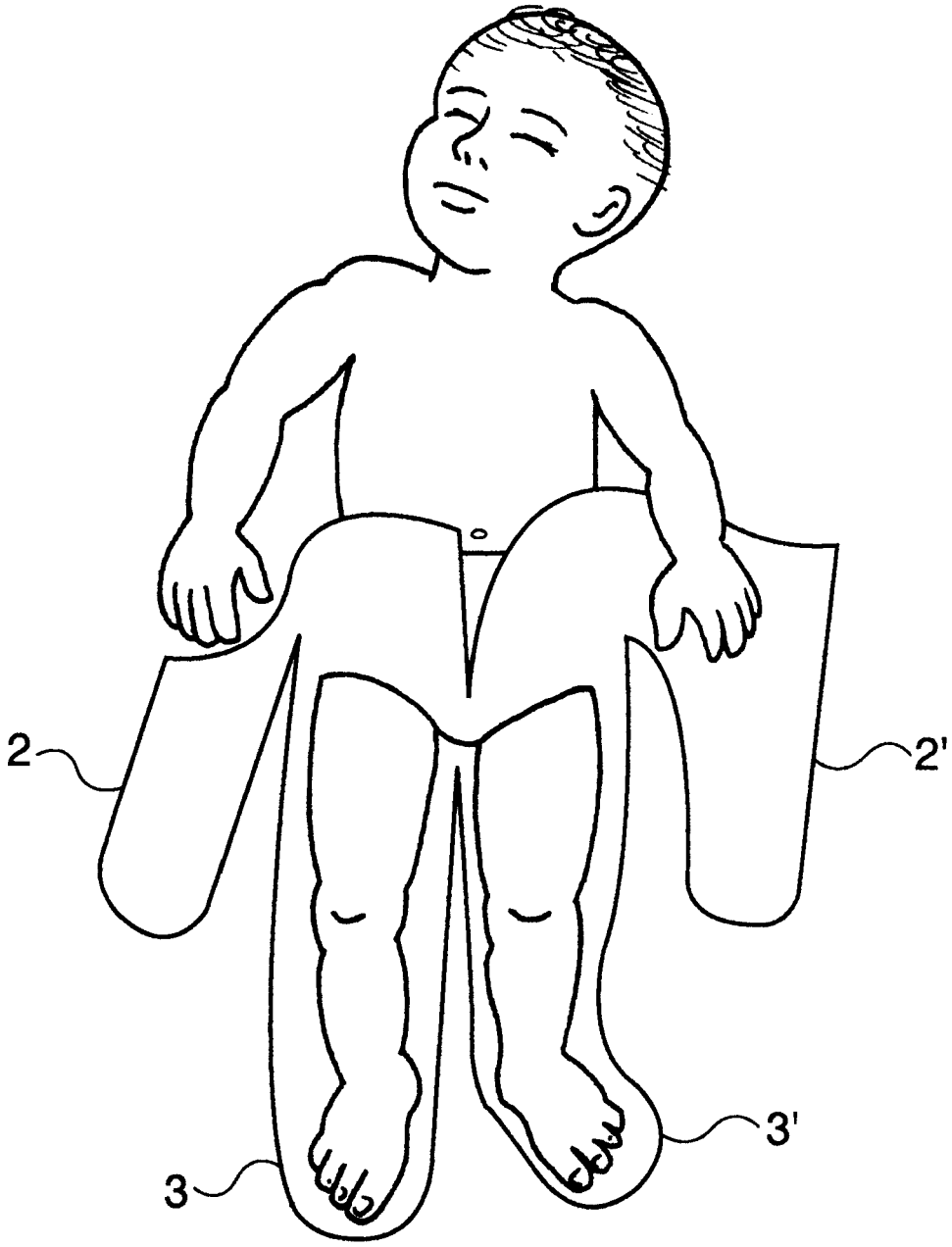
Figures 2, 4B:
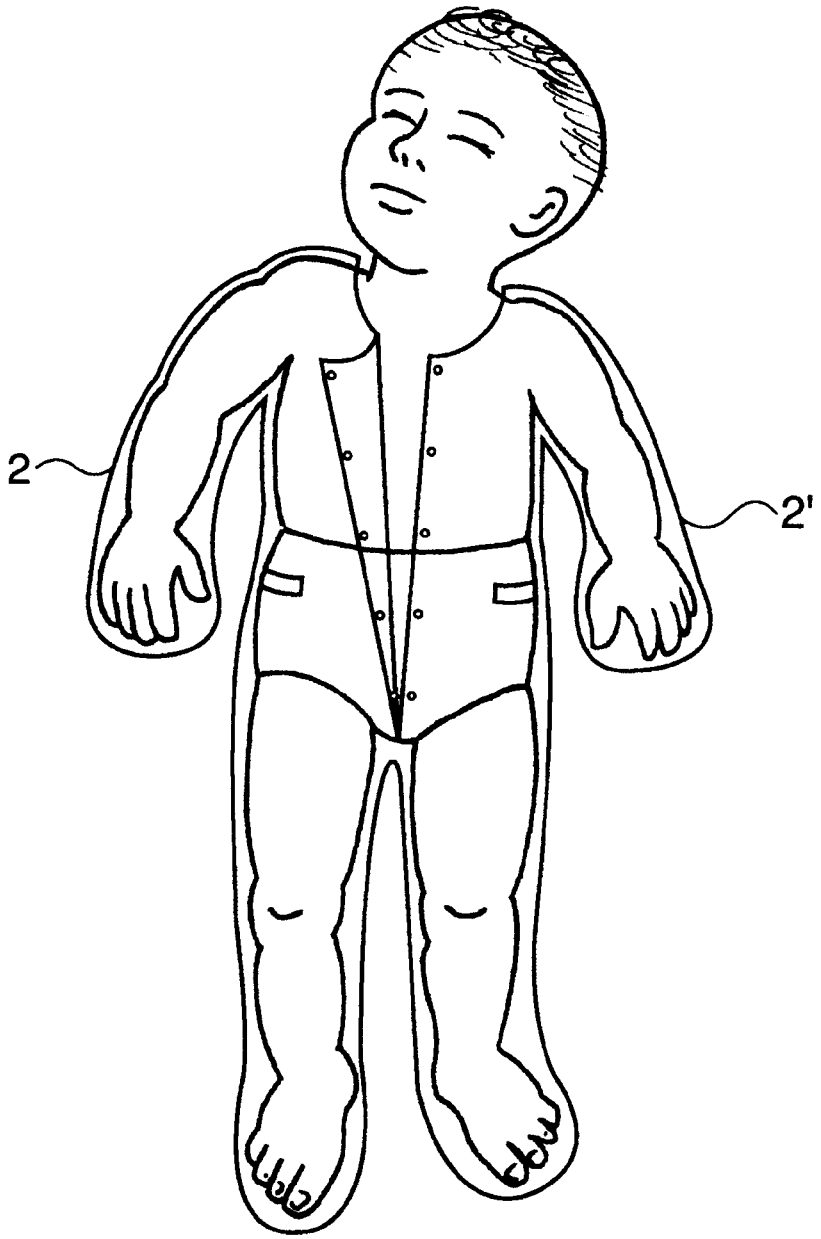
Figures 3, 4B:
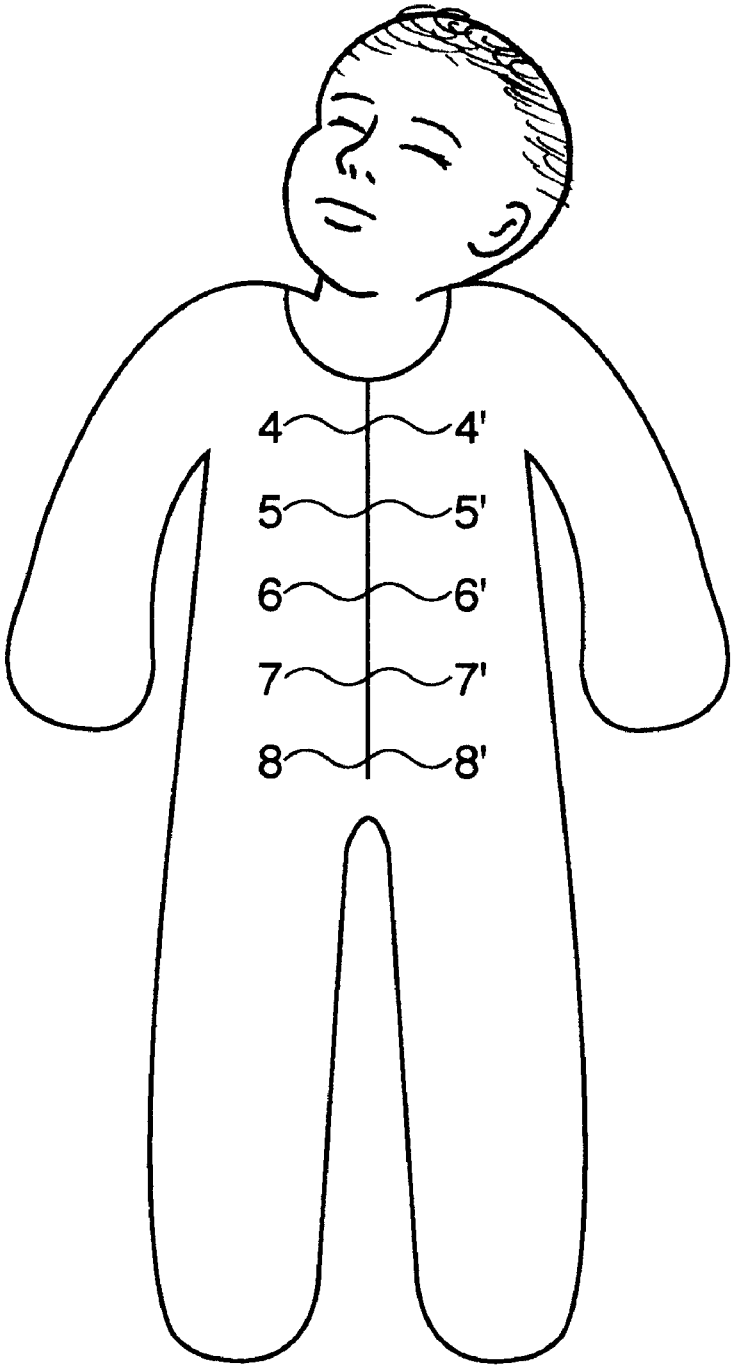

FIG. 4B-1 is a perspective view of the second disposable infant wear garment of FIG. 1B in a first step of dressing an infant. In FIG. 4B-1, a one-piece disposable infant wear garment comprises of a neck opening 1 for the infant's head, two sleeves 2 and 2' for the infant's arms, and two leg parts 3 and 3' for the infant's legs. Neck and sleeve 2 and 2' portion of the garment may be gathered up and the infant's feet and legs put into the leg openings 3 and 3' of the garment.

FIG. 4B-2 is a perspective view of the second disposable infant wear garment of FIG. 1B in a second step of dressing on an infant. Once legs have been inserted into the garment, the upper half of the garment may be pulled up and arms inserted into sleeves 2 and 2'.

FIG. 4B-3 is a perspective view of the second disposable infant wear garment of FIG. 1B in as dressed on an infant, illustrating the fastening technique. In FIG. 4B-3, the left side of the garment and right side are brought together and left side closures 4, 5, 6, 7, and 8 are attached to right side closures 4', 5', 6', 7', and 8'. As noted above, closures 4-4', 5-5', 6-6', 7-7', and 8-8' may comprise hook-and-loop fastener dots, snaps, buttons, ties, or the like. A suitable tie may be constructed from strips of garment material.

A third embodiment of the present invention is described in connection with FIGS. 1C, 2C, 4C-1, 4C-2, and 4C-3.

Figure 1C:
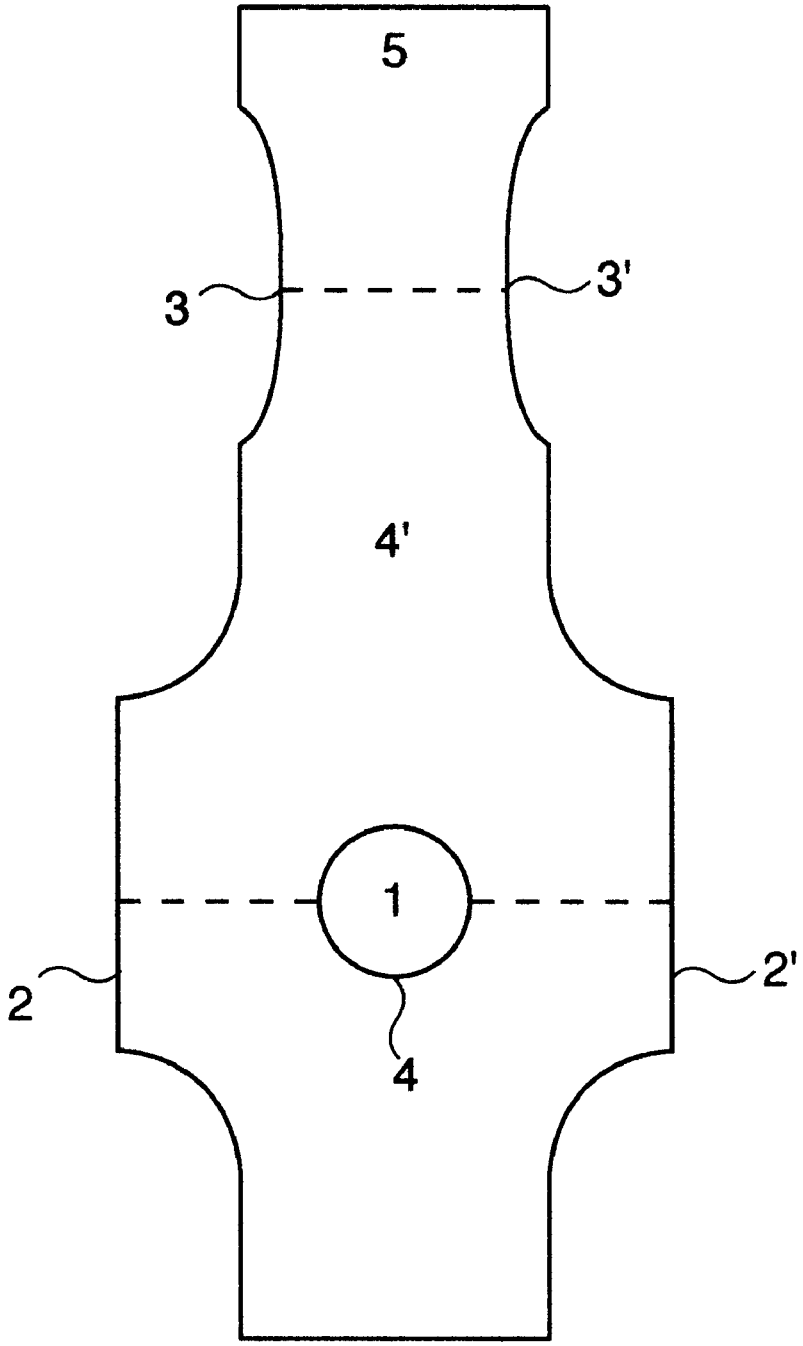
FIG. 1C is a top view of a pattern cut-out of a third disposable infant wear garment of the present invention.

FIG. 1C is a top view of a pattern cut-out of a third disposable infant wear garment of the present invention. In FIG. 1C, a disposable one piece infant garment is provided, cut in one piece with a neck opening 1, and two sleeves 2 and 2' and two leg openings 3 and 3' with the front 4 and back 4' with the wrap around front waist 5 of the garment extending in opposite directions. A slit 1*a* of predetermined dimension (e.g., 2 inches) may be provided the back center of neck opening 1.

Figure 2C:
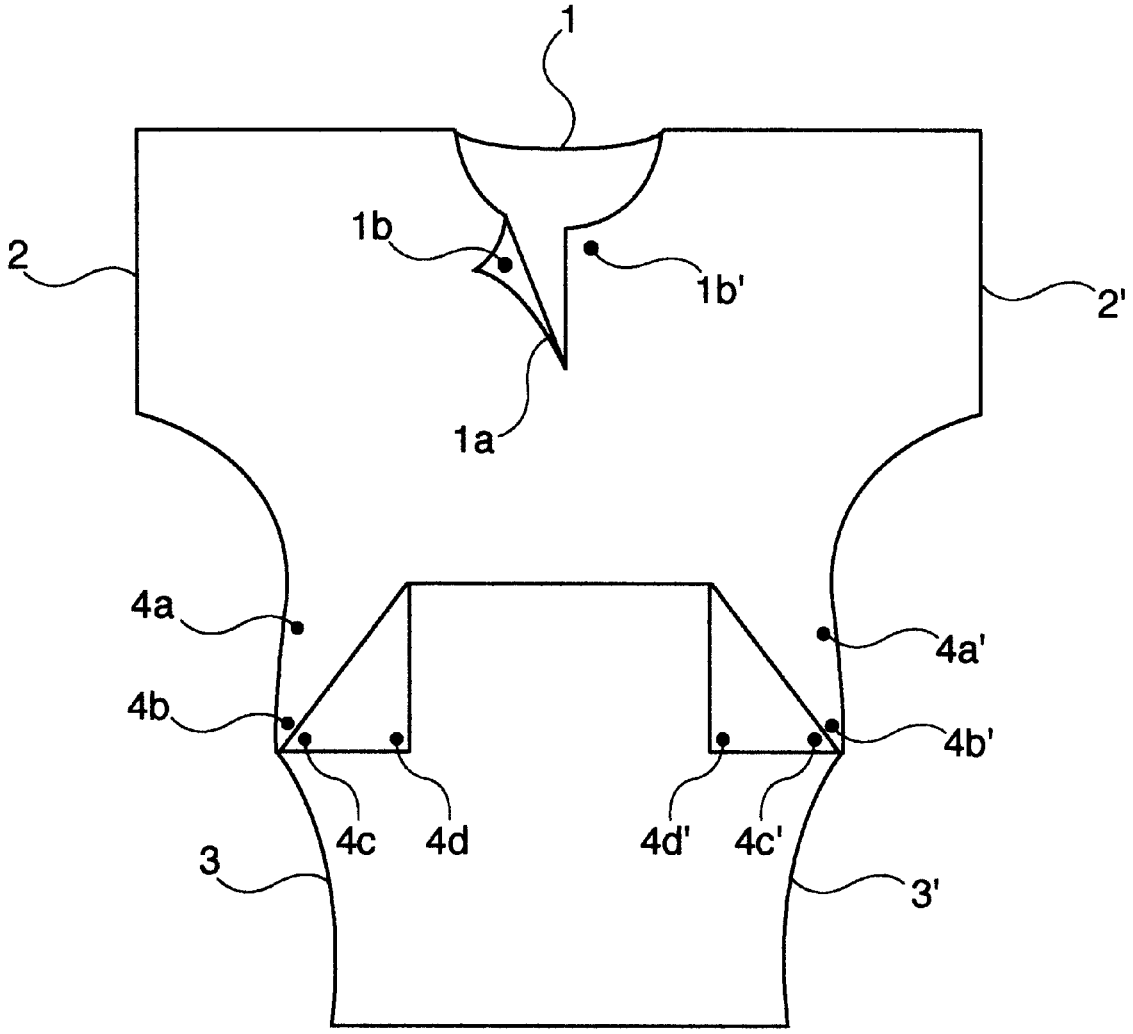
FIG. 2C is a front view of the third disposable infant wear garment of FIG. 1C in assembled form.

FIG. 2C is a front view of the third disposable infant wear garment of FIG. 1C in assembled form. In FIG. 2C, the disposable one piece infant garment is provided with a neck opening 1 with a 2" slit at back center 1*a*, two sleeves 2 and 2' and two leg openings 3 and 3' with foot coverings 3*a* and 3*a*'. Hook and loop or other desired closure system components are attached at each side of slit at neck opening 1*b* and 1*b*', at sides of waist 4*a* and 4*a*', 4*b* and 4*b*', 4*c* and 4*c*', and 4*d* and 4*d*'.

Figures 1, 4C:
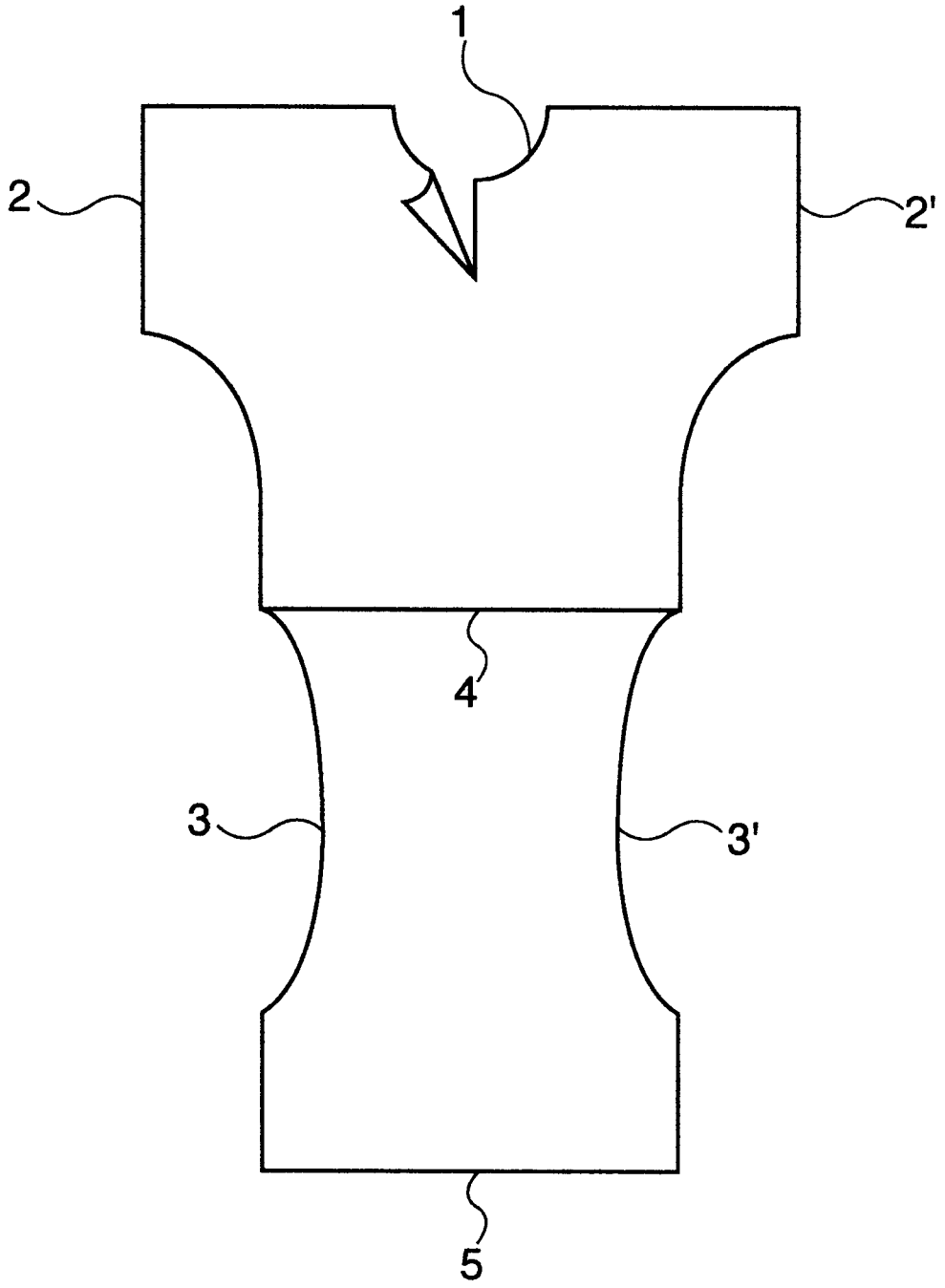
Figures 2, 4C:
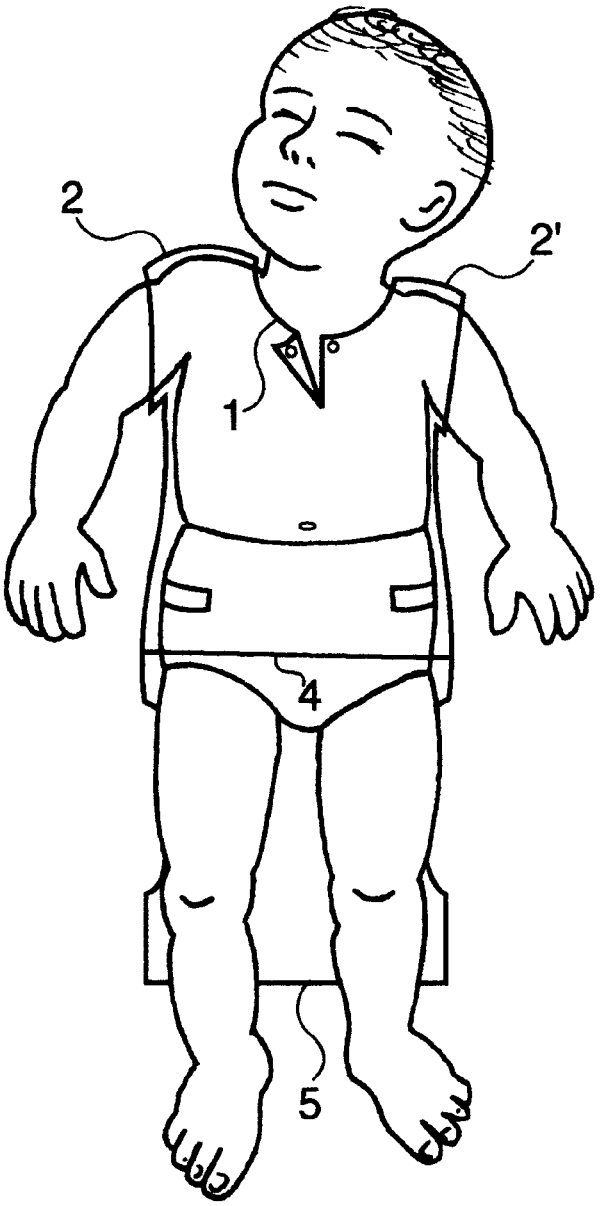
Figures 3, 4C:
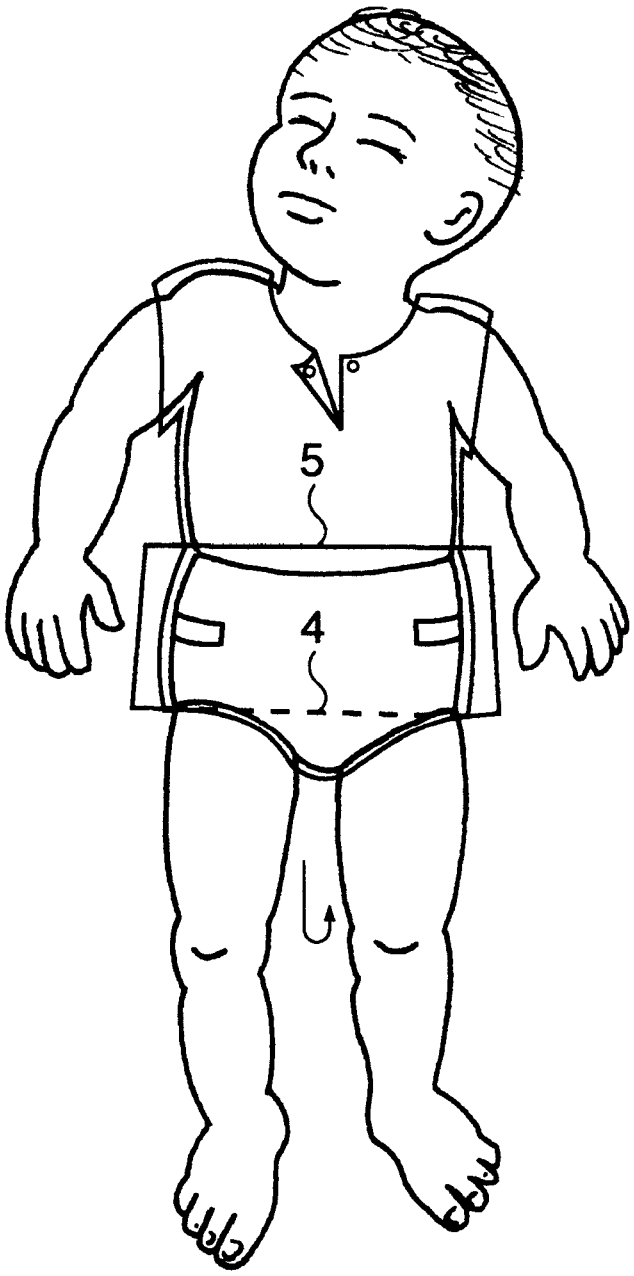

FIG. 4C-1 is a front view of the third disposable infant wear garment of FIG. 1C, as assembled. Front and rear halves of the upper portion of the garment may be sewn, adhered heat-welded, or sonically welded together. The assembled garment produces a neck opening 1 for the infant's head, two sleeves 2 and 2' for the infant's arms, a waist opening 4 for the infants body, two leg openings 3 and 3' for the infant's legs, and a wrap up waist flap 5.

FIG. 4C-2 is a perspective view of the third disposable infant wear garment of FIG. 1C in a first step of dressing an infant. In FIG. 4C-2, the upper half of the garment may be gathered up waist opening 4 and pulled down over infant's head until the infant's head is through neck opening 1. The infant's arms may then be inserted through sleeve openings 2 and 2'. Waist-opening 4 may be pulled down to the infant's waist and wrap-up waist flap 5 pulled down past the infant's bottom.

FIG. 4C-3 is a perspective view of the third disposable infant wear garment of FIG. 1C in a second step of dressing an infant. In FIG. 4C-3, wrap-up waist flap 5 may be pulled up between infant's legs and up to overlap waist opening 4.

Figures 4, 4C:
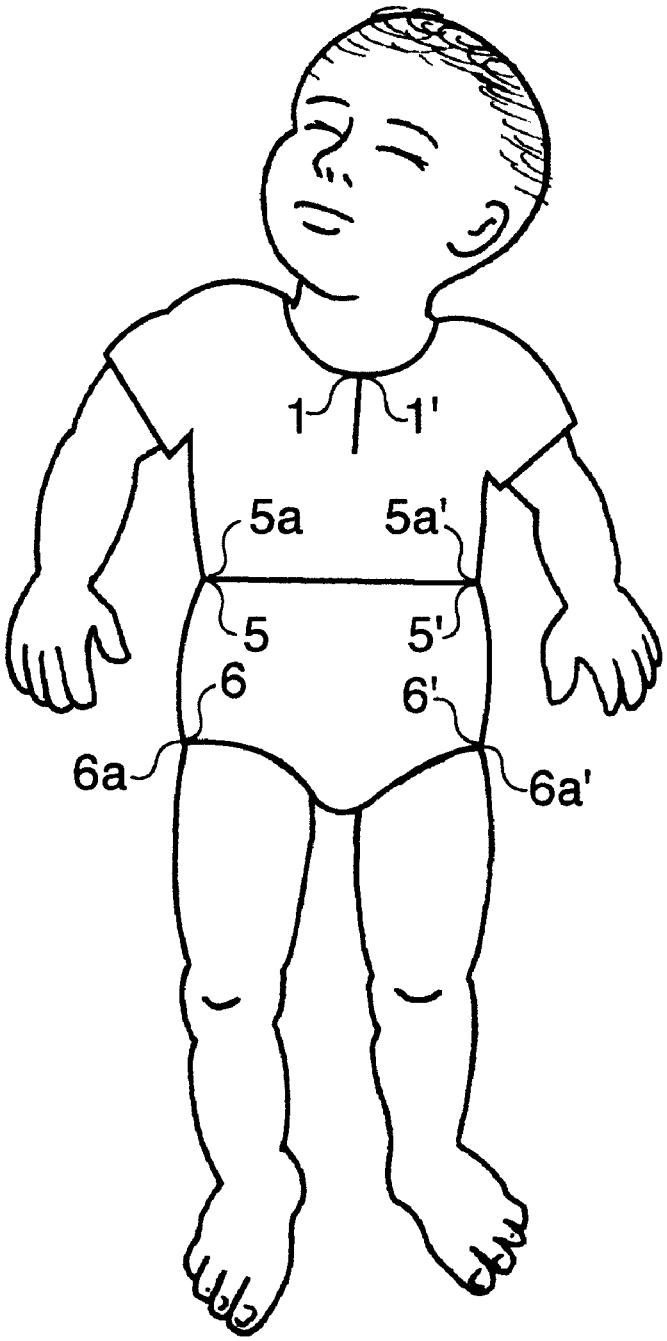

FIG. 4C-4 is a perspective view of the third disposable infant wear garment of FIG. 1C in a third step of dressing an infant. In FIG. 4C-4, the left side facing neck opening 1 is brought forward and attached using the closure system at the right side neck opening 1'. The sides of wrap-up waist flap may be attached with closure systems 5 and 5*a*, 5' and 5*a*', 6 and 6*a*, 6' and 6*a*'. The resulting garment may allow concurrent use and easy access for, a diaper or the like.

Figure 5:
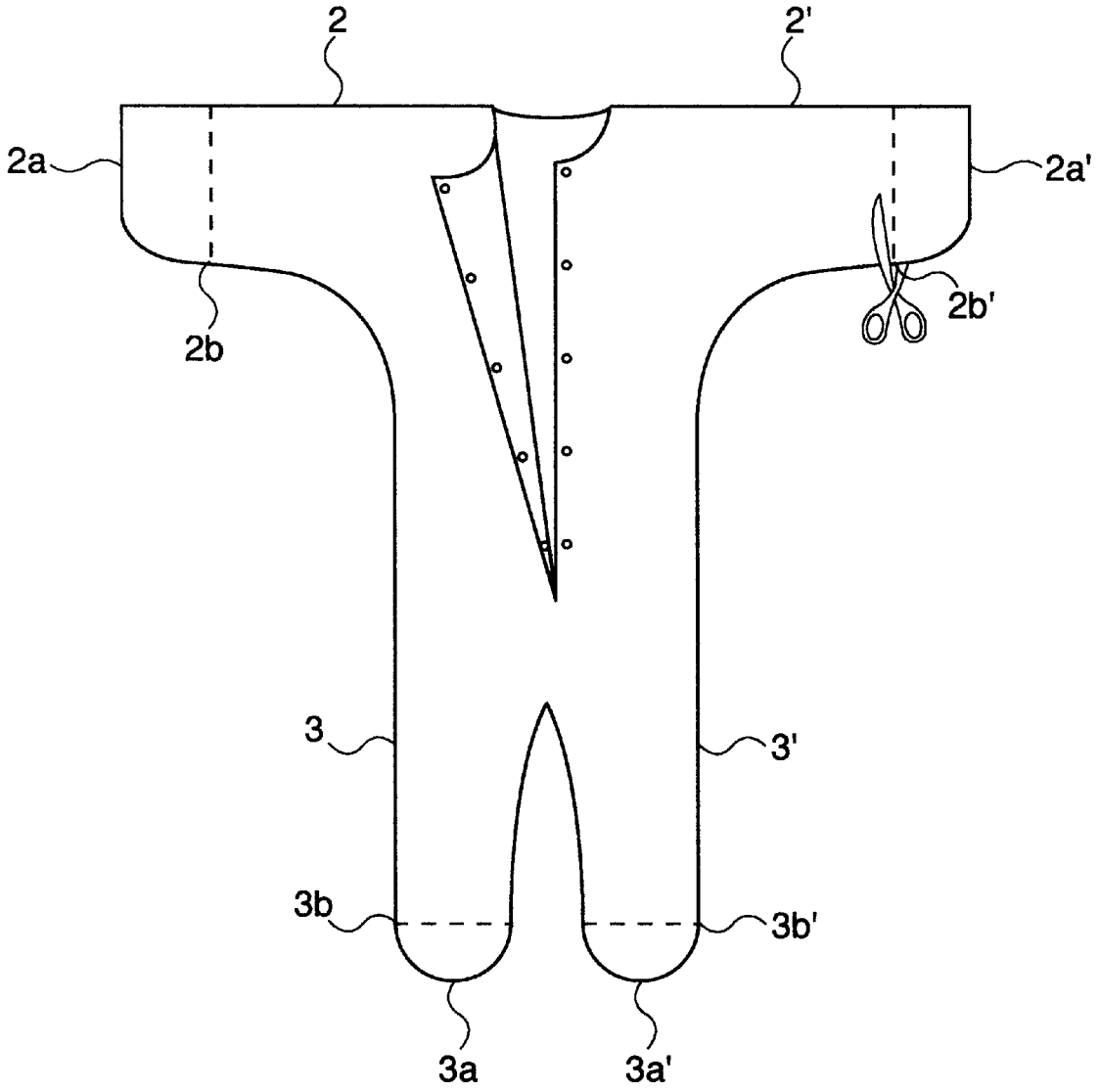
FIG. 5 is a perspective view of the embodiment of FIG. 1B, illustrating how unwanted hand and foot coverings may be cut off before use.

FIG. 5 is a perspective view of the embodiment of FIG. 1B, illustrating how unwanted hand and foot coverings may be cut off before use. FIG. 5 illustrates a disposable one piece infant wear garment with a neck opening 1, two sleeves 2 and 2' with hand coverings 2*a* and 2*a*', the body of the garment 3, and two leg openings 3 and 3' with foot coverings 3*a* and 3*a*'. To cut off undesired hand coverings, scissors may be used to cut vertically at 2*b* and 2*b*' across the entire sleeve 2 and 2'. Likewise, to cut off undesired foot coverings, scissors may be used to cut horizontally at 3*b* and 3*b*' across the entire leg parts 3 and 3'.

The cutting technique of FIG. 5 may be used to alter any of the garments of the present invention. Non-woven spun fibers lend themselves to such alteration, as they do not tend to unravel when cut (as woven fabrics do). In addition to cutting, pre-perforated portions may be provided to allow unwanted portions to be torn off. Similarly, tear strings may be provided in the garment to tear off unwanted portions (or open a garment when non-reusable adhesives are utilized).

Figure 6:
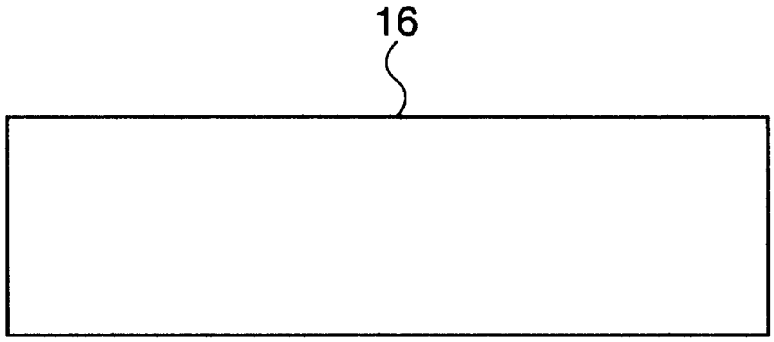
FIG. 6 is a plan view illustrating a disposable insert.

Other embodiments of the present invention may be applied to other types of garments and items. FIG. 6 is a plan view illustrating a disposable insert 16. Disposable infant insert sheet 16 may be made of the same non-woven polyester fabric as the disposable infant garments discussed above, with inserts saturated in mother's scent to comfort infant during sleep periods. This infant sheet may be used to facilitate the infant/mother bonding process.

Figure 7:
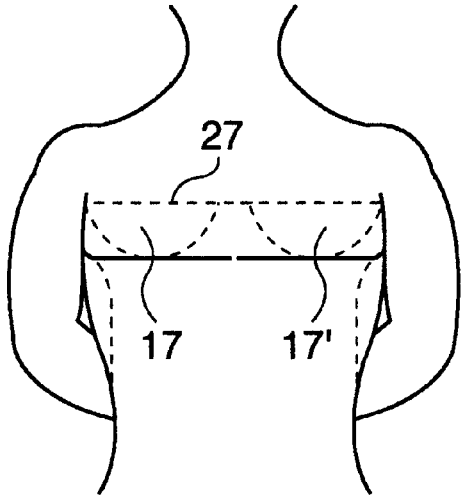
FIG. 7 is a perspective view of the disposable insert of FIG. 6, placed against the skin (inside of bra).

As illustrated in FIG. 7, mother 27 may wear the insert(s) 16 of FIG. 6 against her skin (inside of bra 17) for a period of time to pick up her scent, as illustrated in FIG. 7. The insert would may then be placed in the pocket of the sheet so that the infant can smell his/her mother and be comforted by her scent while sleeping.

Figure 8:
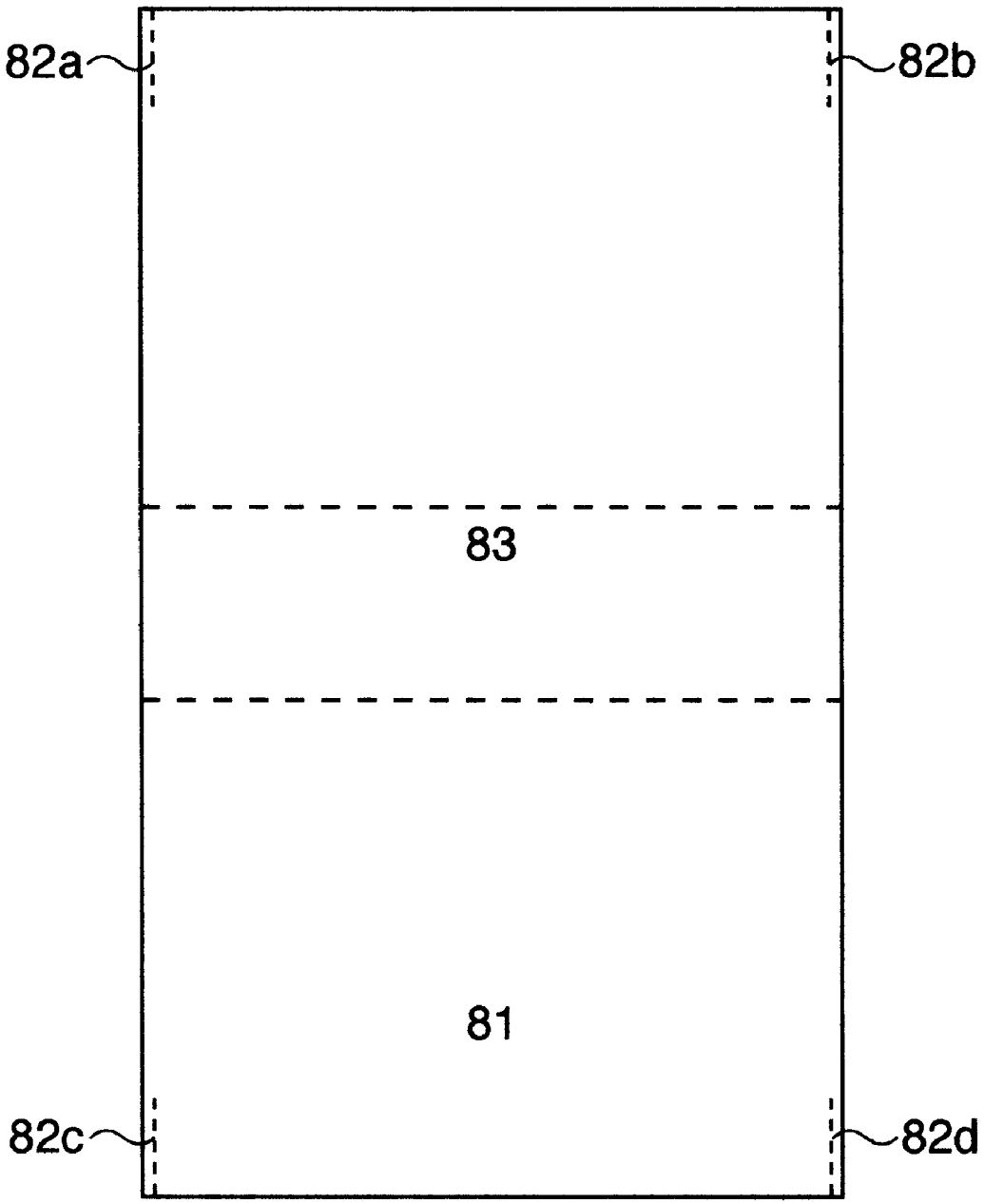
FIG. 8 shows top view of disposable infant sheet. The sheet is comprised of corners to fit around ends of mattress (2*a*, 2*b*, 2*c*, 2*d*) and a folded/sewn pocket on the underside of the sheet.

FIG. 8 shows top view of a disposable infant crib or bed sheet 81. Sheet 81 may be comprised of corners to fit around ends of mattress (82*a*, 82*b*, 82*c*, 82*d*) and a folded/sewn pocket 83 on the underside of the sheet. Infant sheet 81 may be placed over the mattress and used as disposable linens, cutting down on laundry labor and costs for both institutional and home use.

Figure 9:
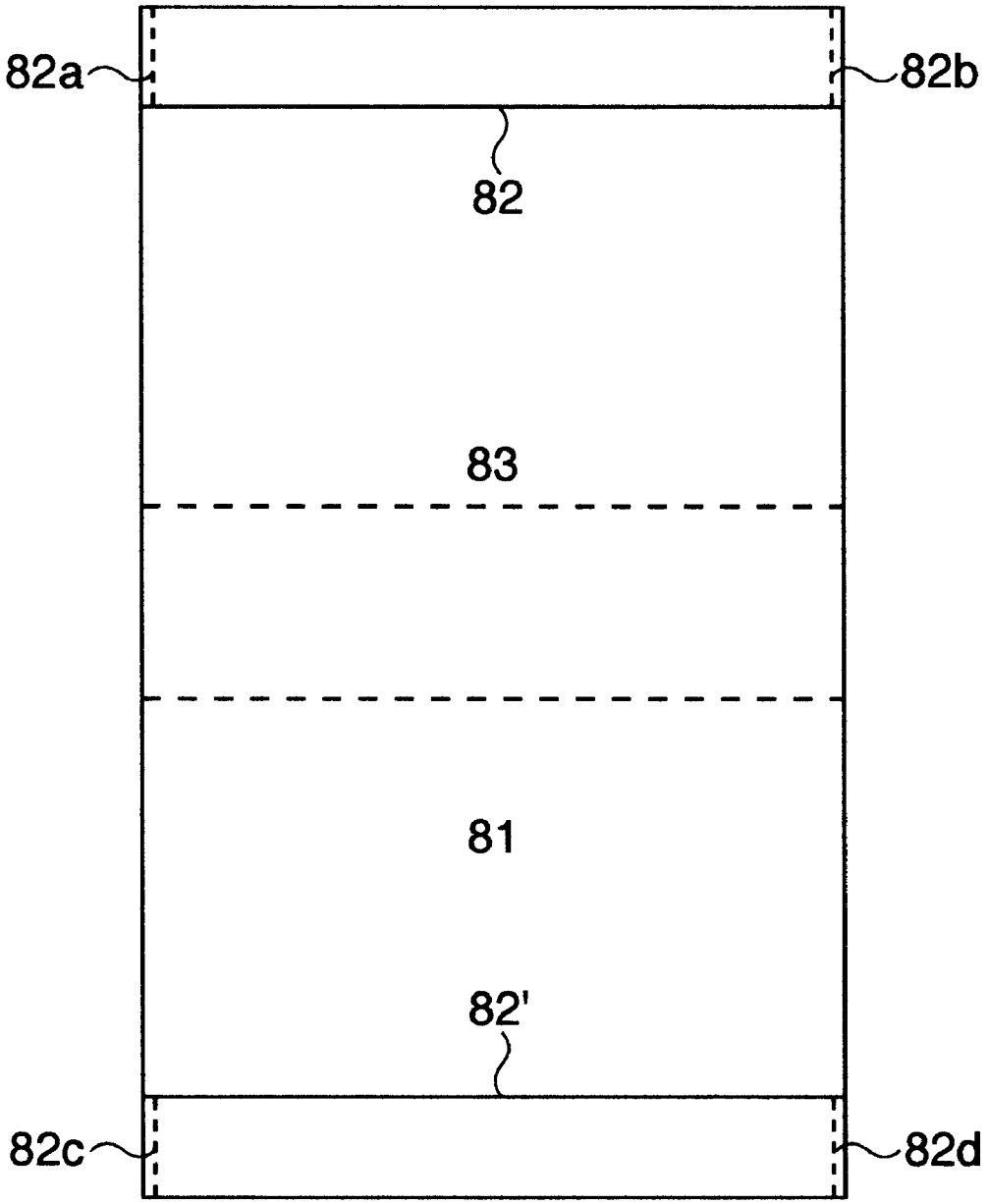
FIG. 9 shows the underside view of the infant sheet where the top and bottom edges 2 and 2' are folded over and attached at the corners 2*a*, 2*b*, 2*c*, 2*d*. There is a folded 'pocket' 3 to accommodate the scented insert 4.

FIG. 9 shows the underside view of the infant sheet where the top and bottom edges 82 and 82' are folded over and attached at the corners 82*a*, 82*b*, 82*c*, 82*d*. A folded 'pocket' 83 may be used to accommodate the scented insert of FIG. 6.

Figure 10:
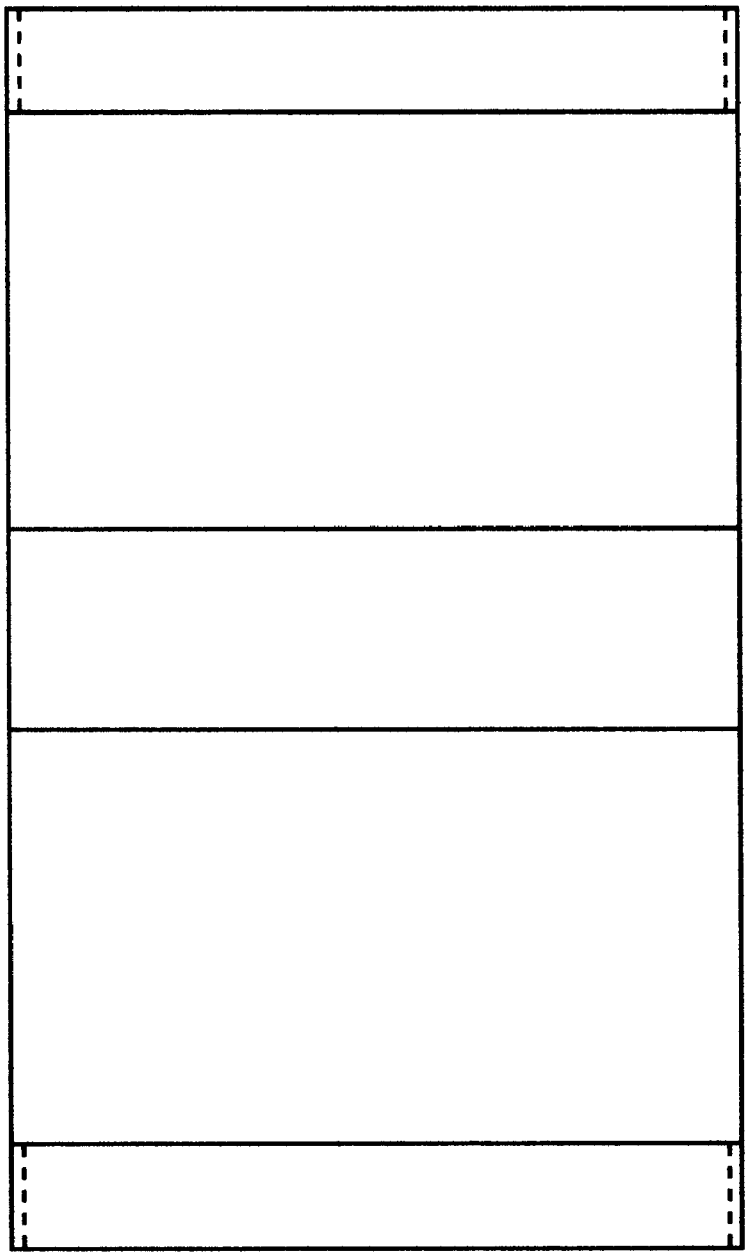
FIG. 10 shows the underside view of the disposable infant sheet 1 with top and bottom edges 2 and 2' folded over and attached at corners 2*a*, 2*b*, 2*c*, 2*d*. View shows the insert 4 in the folded pocket 3.

FIG. 10 shows the underside view of the disposable infant sheet 1 with top and bottom edges 82 and 82' folded over and attached at corners 82*a*, 82*b*, 82*c*, 82*d*. Again, the insert of FIG. 6 may be inserted into folded pocket 83.

While the preferred embodiment and various alternative embodiments of the invention have been disclosed and described in detail herein, it may be apparent to those skilled in the art that various changes in form and detail may be made therein without departing from the spirit and scope thereof.

I claim:

1. A disposable infant wear garment comprising:

a piece of soft and pliable non-woven fabric cut into a predetermined infant garment pattern, said piece of soft and pliable non-woven fabric being disposable, said predetermined infant garment pattern having a neck opening, a first appendage portion extending in one direction from the neck opening for forming a first sleeve, a second appendage portion extending in a substantially opposite direction of the first appendage portion from the neck opening for forming a second sleeve, and two main body appendage portions, extending in opposite directions from each other on either side of the neck opening and substantially orthagonal direction from the first and second appendage portions; and means for permanently joining portions of the soft and pliable non-woven fabric when the infant garment pattern is folded in half along a line bisecting the neck opening, the first appendage portion, and the second appendage portion, said means for permanently joining attaching edge portions of the folded garment together to form at least a portion of the infant wear garment such that the first appendage portion forms a first sleeve extending in one direction from the neck opening, the second appendage portion forms a second sleeve extending in an opposite direction from the neck opening, and the two main body portions attach to one another via the means for permanently joining to form a main body portion of the disposable infant wear garment extending from the neck opening in a direction substantially orthagonal from the first and second sleeves, wherein the disposable infant wear garment is suitable only for a limited number of uses and may be readily disposed after a limited number of uses.

2. The disposable infant wear garment of claim 1, wherein the piece of pliable non-woven fabric is cut into the infant garment pattern in one main piece and folded in half to be assembled such that the fold forms one seam of the disposable infant garment.

3. The disposable infant wear garment of claim 2, wherein said means for permanently joining portions of the soft and pliable non-woven fabric comprise two or less seams.

4. The disposable infant wear garment of claim 3, wherein the two or less seams comprise sonically welded seams.

5. The disposable infant wear garment of claim 3, wherein the two or less seams comprise heat welded seams.

6. The disposable infant wear garment of claim 3, wherein the two or less seams comprise stitched seams.

7. The disposable infant wear garment of claim 1, wherein the neck opening further comprises:

a slit portion, extending from the neck opening in a direction of at least one of the two main body appendage portions; and fastening means for at least partially closing the slit portion.

8. The disposable infant wear garment of claim 7, wherein said fastening means for at least partially closing the slit portion comprises at least one tie made from the soft and pliable non-woven fabric.

9. The disposable infant wear garment of claim 7, wherein said fastening means for at least partially closing the slit portion comprises a hook and loop closure system.

10. The disposable infant wear garment of claim 7, wherein said fastening means for at least partially closing the slit portion comprises snaps.

11. The disposable infant wear garment of claim 7, wherein said fastening means for at least partially closing the slit portion comprises adhesive.

12. The disposable infant wear garment of claim 7, wherein said means for at least partially closing the slit portion comprises at least one tie made from the soft and pliable non-woven fabric, said at least one tie being attached to the soft and pliable non-woven fabric by joining the at least one tie to one of the two or less seams.

13. The disposable infant wear garment of claim 12, further comprising:

ties at the wrists and ankles provided for added warmth and adjustment for proper fit.

14. The disposable infant wear garment of claim 1, wherein the first and second sleeves each include integral hand and foot coverings for added warmth and protection of an infant's delicate skin.

15. The disposable infant wear garment of claim 14, wherein the hand and foot coverings may be cut-off if not desired.

16. A disposable infant wear garment comprising:

a piece of soft and pliable non-woven fabric cut into a predetermined pattern;

means for joining portions of the soft and pliable non-woven fabric to form at least a portion of the garment;

at least one opening formed in the garment for inserting an appendage or head of an infant;

integral hand and foot coverings for added warmth and protection of an infant's delicate skin; and perforated portions in the soft, pliable non-woven fabric, to allow the hand and foot coverings to be torn off.

17. The disposable infant wear garment of claim 1 wherein said two main body appendage portions each include first and second leg portions extending outward from a main body portion of each of the two main body appendage portions such that when the infant garment pattern is folded, the first and second leg portions of the two main body appendage portions form first and second legs for accepting an infant leg.

18. The disposable infant wear garment of claim 1 wherein one of said two main body appendage portions includes a further appendage portion extending outward from the one main body appendage portion such that when the infant garment pattern is folded and permanently joined, the further appendage portion forms a flap at a lower portion of the main body portion of the disposable infant wear garment, side edge portions of said flap being joined to side edge portions of the main body portion of the disposable infant wear garment such that, when the flap is turned inside-out, it forms a closure on a lower portion of the disposable infant wear garment.

* * * * *